US005628080A

United States Patent [19]

Quintile

[11] Patent Number: 5,628,080

[45] Date of Patent: May 13, 1997

[54] CURVE FORMED PROTECTIVE AND DECORATIVE BEDDING FOUNDATION CORNER GUARD

[75] Inventor: Mark J. Quintile, Brunswick, Ohio

[73] Assignee: Ohio Mattress Company Licensing and Components Group, Cleveland, Ohio

[21] Appl. No.: 288,126

[22] Filed: Aug. 10, 1994

[51] Int. Cl.[6] ..... A47C 23/00

[52] U.S. Cl. ..... 5/663; 5/254; 5/739

[58] Field of Search ..... 5/193, 279.1, 280, 5/286, 466, 663, 907, 254, 260, 246, 474; 267/80

[56] References Cited

U.S. PATENT DOCUMENTS

| | | | |
|---|---|---|---|
| D. 235,957 | 7/1975 | Mills et al. . | |
| 2,951,252 | 9/1960 | Roche | 248/345.1 X |
| 3,030,728 | 4/1962 | Wesman | 248/345.1 |
| 3,041,775 | 7/1962 | Brown, Jr. et al. | 248/395.1 |
| 3,406,411 | 10/1968 | Reis | 5/474 |
| 3,546,725 | 12/1970 | Tambascio | 5/907 X |
| 3,710,405 | 1/1973 | Watts . | |
| 3,717,886 | 2/1973 | Watts . | |
| 3,725,188 | 4/1973 | Kalt | 248/345.1 X |
| 3,738,259 | 6/1973 | Hochstatter . | |
| 4,251,308 | 2/1981 | Miller . | |
| 4,740,034 | 4/1988 | Snyder et al. | 248/345.1 X |
| 5,005,237 | 4/1991 | Luchonok . | |
| 5,265,291 | 11/1993 | Callaway | 5/254 |

*Primary Examiner*—Michael F. Trettel
*Attorney, Agent, or Firm*—Calfee Halter & Griswold

[57] ABSTRACT

A protective and decorative mattress foundation curved corner guard is mold formed in a curved configuration with a wall portion of the guard having a radius of curvature approximately equal to a radius of curvature of rounded corners of a mattress foundation to which the corner guard is to be attached. Raised areas in the form of indicia are mold formed to protrude from a front surface of the curved wall. Edges of the raised areas are bevelled to allow mold pieces to be withdrawn from the front surface of the curved wall without damage to the molded guard. When mold formed of a suitable plastic material, the curved corner guard, including the curved wall and raised indicia thereon, can be metal plated and polished.

15 Claims, 3 Drawing Sheets

CURVE FORMED PROTECTIVE AND DECORATIVE BEDDING FOUNDATION CORNER GUARD

FIELD OF THE INVENTION

The present invention relates generally to molded components for mattress foundations and, in particular, to molded protective guards for attachment to exterior corners of mattress foundations.

BACKGROUND OF THE INVENTION

Corner guards are commonly attached to the lower exterior rounded corners of mattress foundations or "box springs", to protect the fabric which covers the foundation and foundation frame. Such corner guards typically extend in two dimensions about each corner; over a small area of the vertical side of the curved corner of the foundation, and over a small area of the bottom of the foundation adjacent the corner.

Foundation corner guards have heretofore been produced by molding a flat piece adapted to cover a small area of the vertical side of the rounded corners of a foundation, with securement tabs extending perpendicular from the flat piece to extend underneath the foundation for attachment to the bottom of the frame adjacent the corner. Such guards are installed upon the foundation by wrapping or bending the flat piece around the corner and securing the tabs to the foundation frame by fasteners driven through the tabs, the material over the foundation, and into the bottom of the frame members at the corners.

One disadvantage of this type of corner guard is the inherent structural weakness which is necessary to allow it to be bent around the corner. Even with secure attachment of the tabs of the guard to the frame, the right angle intersection of the tabs with the bent flat piece is not strong enough to prevent separation or peeling of the flat piece away from the corner upon application of even a relatively small force. Thus the guards can be easily damaged. Another disadvantage is the difficulty of correctly positioning the guard about the corner during manufacture so that the flat piece extends in equal distances from the mid-point of the curved corner. Other disadvantages are the difficulties of getting the flat piece to tightly conform to the curved vertical wall surface, and the resultant sloppy appearance of an ill fit. Even guards which appear to conform to the curve of the corner at the factory can be easily detached, broken or warped due to weakness induced by the post-molding bending. Also, the required bending precludes application of any type of finish to the exterior of the guard which would crack when the guard is bent around the curved corner.

It has been recognized in recent years that corner guards can be exploited in the marketing and product image enhancement of bedding foundations. Providing a finished appearance to the lower end of the rounded corners of mattress foundations is particularly important in the marketing and sale presentation of mattress foundations wherein the foundation corners are fully exposed. The appearance of the corners is especially important in the marketing and sale of superior quality mattress foundations which are displayed, for example, by placement in elaborate display stands in which the corners of the foundation are fully exposed from all angles, such as in a rotatable display stand.

As a result of the flat configuration molding process, corner guards of the prior art generally do not conform well to the curved foundation corners, and are structurally weak as a result of the necessary bending from the flat configuration. Moreover, corner guards of the prior art are rather unattractive, made in unremarkable in colors and shapes and without any finishes, and therefore have no particular sales value in the form of image enhancement of the finished product.

SUMMARY OF THE PRESENT INVENTION

The present invention overcomes these and other disadvantages of the prior art by providing a pre-configured curve molded protective and decorative foundation corner guard having superior structural characteristics and appearance.

In accordance with one aspect of the invention, a protective and decorative mattress foundation corner guard is injection mold formed in a curved configuration wherein a radius of curvature of a wall portion of the guard is approximately equal to a radius of curvature of rounded corners of a mattress foundation to which the guard is to be attached.

In accordance with another aspect of the invention, a front surface of the curved wall portion of the corner guard is injection mold formed to further include raised areas in the form of indicia which protrude from the front surface of the curved wall.

In accordance with another aspect of the invention, edges of the raised areas injection mold formed to protrude from the front surface of the curved wall are bevelled.

In accordance with another aspect of the invention, a mattress foundation corner guard is injection mold formed in a single piece of ABS resin and an exterior surface of the guard is plated with a material which has an appearance different than the appearance of the ABS resin in a molded form.

These and other aspects of the invention will become apparent to those skilled in the art upon the reading and understanding of the following detailed description made with reference to the annexed drawings in which like reference numerals refer to like parts.

DETAILED DESCRIPTION OF A PREFERRED EMBODIMENT AND METHOD

Figure 1:
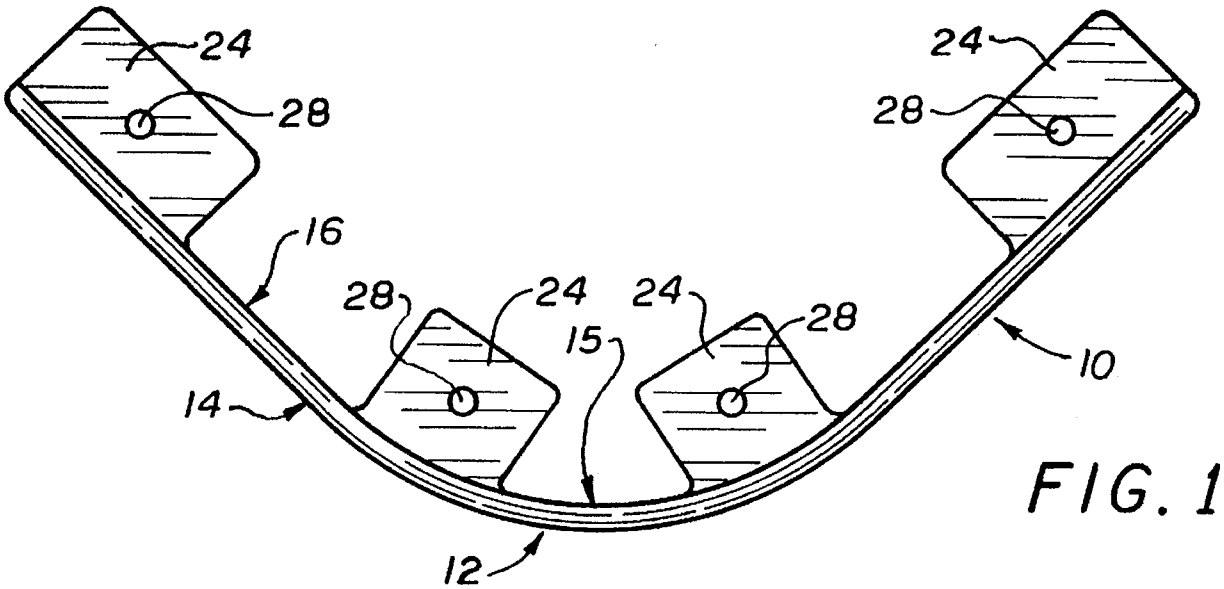
FIG. 1 is a top view of the corner guard of the present invention.
Figure 2:
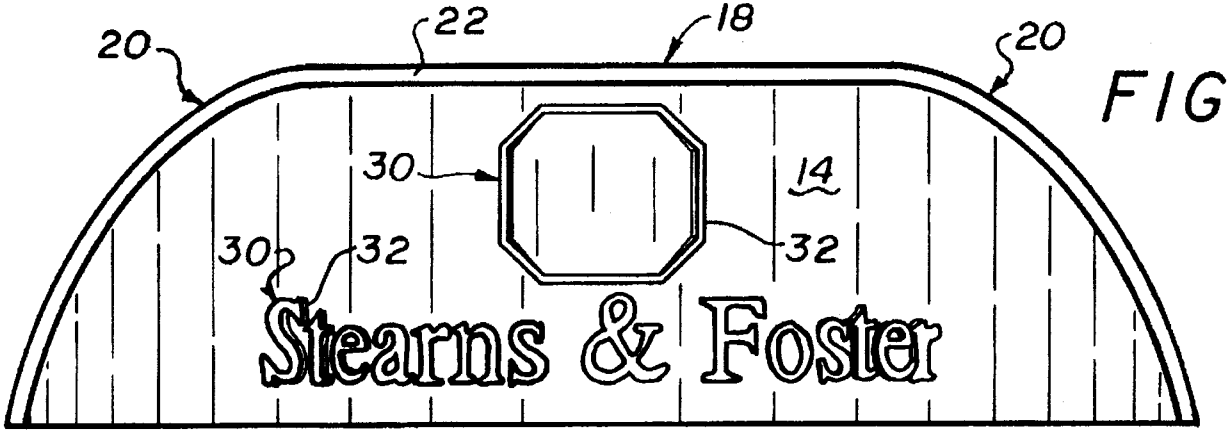
FIG. 2 is a front elevational view of the corner guard of the present invention.
Figure 3:
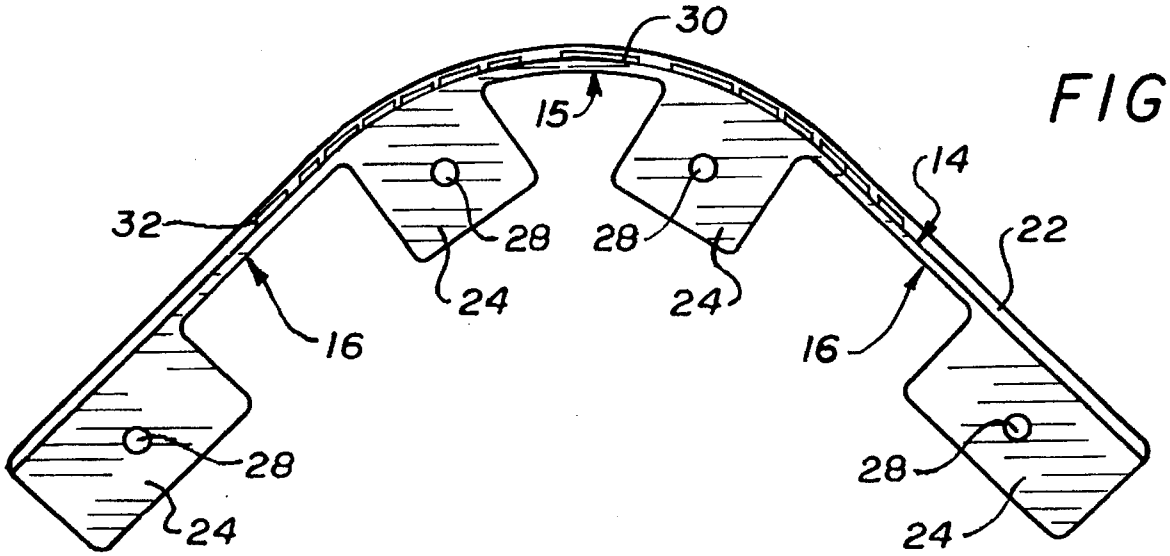
FIG. 3 is a bottom view of the corner guard of the present invention.
Figure 4:
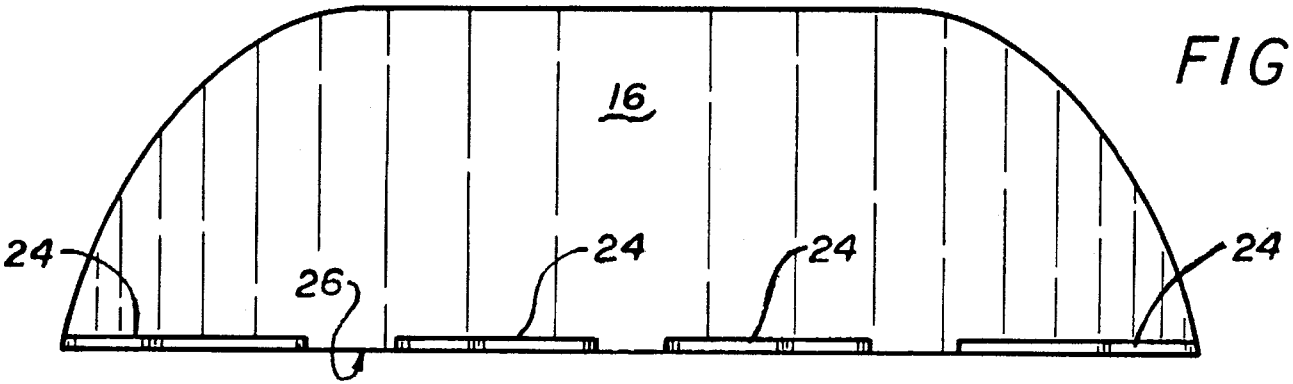
FIG. 4 is a rear elevational view of the corner guard of the present invention.

As shown in the Figures, the injection mold-formed corner guard 10 of the invention includes a curved vertical wall 12 having a front face 14 and a rear face 16, and a radiused curve 15 having a radius of curvature approximately equal to a radius of curvature of a rounded corner of mattress foundation against which the wall 12 is to be mounted flush. Wall 12 has a thickness of approximately 2 mm and a height of approximately 5 cm and a curvilinear length of approximately 20 cm. A top edge 18 of wall 12 includes rounded corners 20 near the ends of the wall and a structural strength enhancing raised ridge 22 having a thickness of approximately 3 mm. Securement tabs 24 are formed at a bottom edge 26 of the wall to extend perpendicularly from rear face 16. Securement tabs 24 may be formed to a length (measured from the rear face 16 to the end of the tab) of, for example, approximately 1.5 cm, and a width (measured parallel to rear face 16) of, for example, approximately 2 to 3 cm. As shown, the width of the tabs positioned at or near the ends of wall 12 may be greater than the width of tabs located inward to increase the structural and attachment strength of the tabs. Each tab may be provided with a through hole 28 to allow for attachment of the corner guard to a foundation frame by screw or nail type fasteners.

The front face 14 of the wall 12 also includes raised relief areas 30 which have a thickness greater than a thickness of wall 12 and may be formed in the shape of indicia such as letters or numerals representing, for example, trade names and/or trade marks. The peripheral edges 32 of the raised relief areas are bevelled to allow these areas to be injection mold formed integral with the front face 14 of wall 12 without damage upon removal from the mold. The raised areas may be placed anywhere upon front face 14 so that they are visible from all angles.

Figure 5:
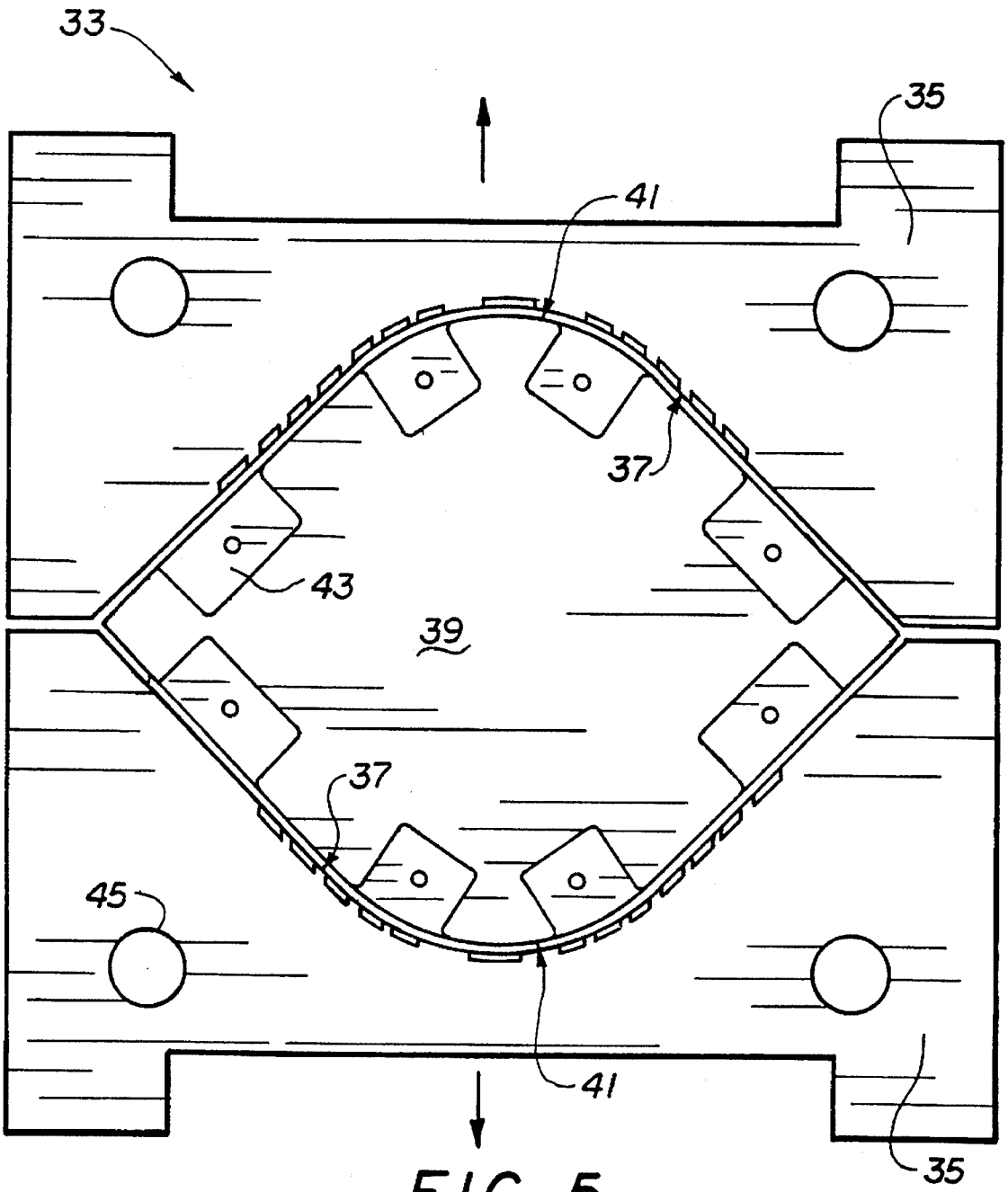
FIG. 5 is a top view of a mold used to form the corner guard of the present invention.

The corner guard is molded in the curved configuration by a conventional automated injection molding process out of any rigidly moldable material such as polyethylene, polypropylene or, preferably, acrylonitrile-butadiene-styrene (ABS). As schematically illustrated in FIG. 5, to mold the corner guard in the curved configuration, a mold set 33 is used which includes outer mold pieces 35 having curved inner surfaces 37 against which the front face 14 of wall 12 (including raised relief areas 30) is formed. The cavities which form raised relief areas 30 are provided in inner surfaces 37 of outer mold pieces 35. An inner mold piece 39 is provided to fit within the space between inner surfaces 37 of outer mold pieces 35. Outer surfaces 41 of inner mold piece 39 are spaced from inner surfaces 37 a distance equal to the desired thickness of wall 12. A top surface of inner mold piece 37 includes depression areas 43 in which securement tabs 24 are formed. A mold top plate (not shown) is aligned with the tops of pieces 35 and 39 by registration guides 45 and secured over the mold cavities during the injection process, as is well known in the plastic injection molding art. Although the mold is described and shown in a symmetrical form in which two guards are simultaneously formed, a single guard mold having the basic configuration of one half of the mold could, of course, be used alternatively.

Upon completion of curing of the parts in the mold set, the mold top plate is removed and outer mold pieces 35 are retracted in the directions indicated to allow removal of the guards. The bevelled edges 32 on the peripheries of raised relief areas 30 allow outer mold pieces 35 to be drawn out of contact with front face 14 of wall 12 without separating or damaging the raised relief areas. This is accomplished by making the bevel angles at the peripheral edges 32 of each of the raised relief areas 30 parallel to the direction of retraction of mold pieces 35. Thus no portion of the inner surface 37 of mold pieces 35 engages any of the raised relief areas upon retraction of the mold pieces 35. This design eliminates the need for cammed operation of multiple mold pieces to form the curved corner guard having raised relief areas.

When molded of ABS or other suitable polymeric material, the corner guards may be coated with a suitable finish such as paint or the like. Alternatively, a pigment can be incorporated into the material used to mold the corner guards, as is well known in the plastic mold injection art, to produce the guards in any desired color. Preferably, the corner guards are made of ABS and metal plated to provide a unique and highly durable plate-finished appearance. For example, to provide a brass finish to the corner guard, each molded part is put through a conventional plating process including the successive steps of dipping in etching, activation and acceleration solutions, application of an electroless nickel layer, and electro-deposition of layers of copper, nickel and brass, followed by application of an electroblack layer which is then buffed to provide an antiqued brass appearance to the guard. Each part may then be sprayed with clear lacquer to protect the finish. Of course other types of metal plate finishes can be applied in similar manners which are well known in the plastic plating art.

By eliminating the need to bend the corner guard to conform to the foundation, alternative types of finishes, such as paint, can be utilized without risk of separation. Alternatively the curved corner guard may be constructed of metal by conventional stamping/metal working processes.

Although the invention has been described in detail with respect to a certain preferred embodiment and method, alterations and modifications of the basic concepts and forms of the invention may become apparent to those skilled in the relevant arts upon reading this specification. The present invention is intended to encompass all such alterations and modifications, and is limited only by the scope of the following claims and equivalents thereto.

What is claimed is:

1. A protective and decorative corner guard constructed in a fixed curved configuration for attachment over an upholstered exterior bottom surface and over an upholstered exterior side surface of a rounded corner of a mattress foundation to protect and decorate the exterior of a corner of an upholstered mattress foundation, the corner guard comprising, (i) a side wall having:

a height which extends from an exterior bottom surface a distance up an exterior side surface of a rounded corner of a mattress foundation, a length sufficient to extend from a first exterior side of a mattress foundation and around an exterior rounded corner of the foundation to an adjoining exterior second side of the foundation generally perpendicular to the first side, a radiused curve fixedly formed in the side wall with a mid-point of the curve positionable at an approximate mid-point of the length of the side wall, the curvature in the side wall having a radius approximately equal to a radius of a rounded corner of a mattress foundation, and (ii) tabs extending generally perpendicular from a bottom edge of the side wall and positionable against an exterior bottom surface of a foundation frame adjacent a rounded corner of the frame when the side wall is positioned against a side surface of a rounded corner a foundation, the tabs being attachable against the bottom exterior surface of the frame.

2. The corner guard of claim 1 wherein a top edge of the side wall is rounded near ends of the length of the side wall.

3. The corner guard of claim 1 further comprising a ridge having a thickness greater than a thickness of the side wall and extending along the top edge of the side wall.

4. The corner guard of claim 1 wherein the side wall further comprises integrally formed indicia formed by raised areas in the shape of the indicia which protrude from a front surface of the side wall, the raised areas having a thickness greater than a thickness of the side wall.

5. The corner guard of claim 4 wherein edges of the raised areas of the indicia are bevelled.

6. The corner guard of claim 5 wherein the edges of the raised areas are bevelled to be parallel with a direction in which a part of a mold used to form the corner guard is withdrawn from the front surface of the side wall after the corner guard is molded.

7. The corner guard of claim 1 made of a plastic material by an injection molding process.

8. The corner guard of claim 7 containing polyethylene.

9. The corner guard of claim 7 containing polypropylene.

10. The corner guard of claim 7 containing acrylonitrile butadiene styrene.

11. The corner guard of claim 7 further comprising a pigment in the plastic material.

12. The corner guard of claim 10 further comprising a plating material applied to a surface of the guard.

13. The corner guard of claim 12 wherein the plating material comprises at least one of copper, brass and nickel.

14. The corner guard of claim 12 further comprising lacquer over the plating material.

15. The corner guard of claim 1 made of metal.

* * * * *